United States Patent [19]

Williams

[11] 4,395,589

[45] Jul. 26, 1983

[54] ELECTRO-ACOUSTICAL STRUCTURE

[75] Inventor: Douglas J. Williams, Huntington Beach, Calif.

[73] Assignee: EECO Incorporated, Santa Ana, Calif.

[21] Appl. No.: 280,650

[22] Filed: Jul. 6, 1981

[51] Int. Cl.[3] ..... H04R 1/10

[52] U.S. Cl. ..... 179/1 SW; 179/1 PC; 179/1 VE; 179/1 ST; 181/137

[58] Field of Search ..... 179/1 SW, 1 PC, 1 VE, 179/1 ST, 182 A, 182 R; 200/276; 181/137; 200/61.19, 159 R, 153 M, 340

[56] References Cited

U.S. PATENT DOCUMENTS

| | | | |
|---|---|---|---|
| 3,450,839 | 6/1969 | Scanlon | 179/1 VE |
| 3,463,886 | 8/1969 | Scanlon | 179/1 VE |
| 3,610,830 | 10/1969 | Daleiden | 179/1 SW |
| 4,028,491 | 6/1977 | Huntress et al. | 179/1 SW |

*Primary Examiner*—G. Z. Rubinson
*Assistant Examiner*—James L. Dwyer
*Attorney, Agent, or Firm*—Harry R. Lubcke

[57] ABSTRACT

An electro-acoustical structure for switching on and supplying sound to an all-acoustical headset upon the insertion of an acoustic-use plug. A piston-valve is depressed against a spring upon the insertion of the plug, opening acoustic ports, and also moving a bifurcated contact attached to the piston to close a circuit with coactive stationary contacts for energizing an electro-acoustic transducer.

9 Claims, 4 Drawing Figures

ELECTRO-ACOUSTICAL STRUCTURE

BACKGROUND OF THE INVENTION

This invention pertains to electro-acoustical devices.

U.S. Pat. No. 4,028,491, issued June 7, 1977 to the same assignee, discloses a transducer switching system that serves the same purpose as the present invention.

However, it has been found that the slotted poppet type valve of the above patent is subject to audio loss out the rear chamber. Once the valve opens it allows any accumulated particles and/or liquids to directly enter the electrical contact area. The slotted valve can be easily damaged by the blade of a screwdriver, or similar object, being inserted into the open cavity, engaged in the slot and rotated; inadvertently by a service man, or otherwise. This breaks the valve and prevents it from ever being used again for its intended purpose.

The switch contact, being a double-wound spring, has had variations in the actuation point as the headset plug was inserted normally into the open cavity. The spring contact makes a butt type electrical connection and is not self-cleaning.

U.S. Pat. No. 3,610,830, Daleiden, discloses a switch 39 that is operated by translation of sleeve 34A when plug 14A is inserted. However, switch 39 makes butt electrical and mechanical contact, and is devoid of any self-cleaning wiping action.

SUMMARY OF THE INVENTION

A piston slide valve minimizes the acoustic leakage out of the aperture(s) when an acoustic plug is not inserted and sound is not to be heard by the passenger. Sound passes to the acoustic-use plug from a side port in the body to a channel in the valve and upward to the castellated top thereof. There is no opening to the electrical contact area; thus, particles and/or liquid cannot enter that area.

A bifurcated electrical switch member is disposed within the valve and is moved downward when an acoustic-use plug is inserted into the body. This switch member contacts stationary contacts below, thus accomplishing the switching-on function. Both switching surfaces of the assembly are wiping, and are thus self-cleaning.

DESCRIPTION OF THE PREFERRED EMBODIMENTS

Figure 1:
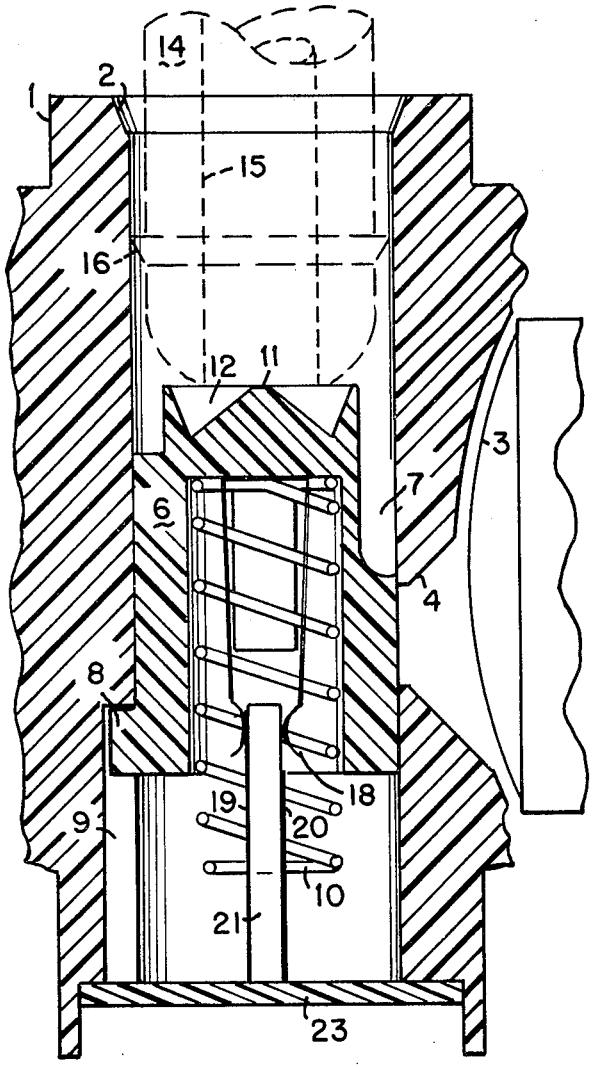
FIG. 1 is an enlarged fragmentary sectional elevation view of the structure.
Figure 2:
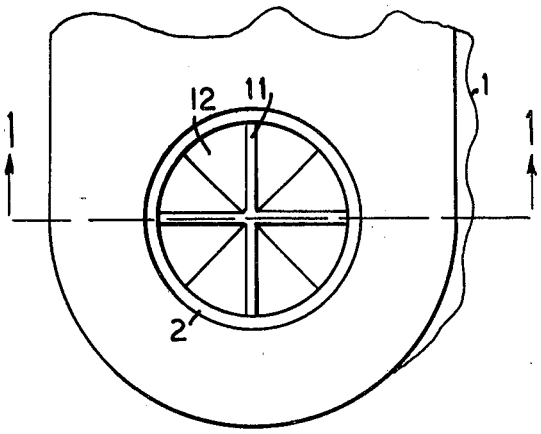
FIG. 2 is a top view of the same; with section lines 1—1.

In FIG. 1, numeral 1 identifies the body of the structure. This is typically molded of a thermoplastic, such as nylon, and in one piece. While the device cxan be made with one aperture 2, it is usually structured with two apertures. This provides for stereophonic sound, upon two transducers 3 and other known stereo apparatus being used.

Adjacent to, and in acoustic communication with, each transducer is a port 4 that extends into an aperture 2.

Piston valve 6 slides in an aperture 2 and performs both mechano-acoustical and electrical switching functions. The valve is shaped as a hollow cylinder, open at the bottom, and having a companion port 7 with respect to port 4.

A key protuberance 8 is circumferentially opposite the companion port. It slides in a keyway 9, so that companion port 7 remains aligned with port 4 at all times. Keyway 9 is of limited length. Thus, valve 6 will translate in aperture 2 only as far. The proportions are arranged so that the upward travel of the valve is stopped shortly after companion port 7 closes with respect to port 4. This is the position shown in FIG. 1.

The valve is urged to this position by coiled helical spring 10, which extends from the bottom of body 1 to within the valve. It has 6½ active and 3 inactive convolutions of 0.25 millimeter (mm) diameter stainless steel spring wire. This spring typically exerts a force of 50 grams with the piston up and 140 grams with it depressed.

At the top and bottom 1½ convolutions are formed flat to suitably seat the spring. The spring diameter is 4 mm.

The castellated top of valve 6 is formed of plural, say four, raised portions 11, with intervening depressed portions 12, in a ramped configuration.

The electro-acoustical structure of this invention is used with an acoustic-use plug 14, which may be part of the Arinc 574 headset. This plug is outwardly cylindrical, in order to fit into aperture 2, and is hollow, with passageway 15 for the sound from this structure to pass through known flexible tubes to the ears of the user.

The castellated top of valve 6 provides mechanical means for taking the downward force exerted upon plug 14 by the user in inserting it for use. This is taken by raised portions 11. The depressed portions 12 allow sound to pass from port 4, through companion port 7, through depressed portions 12, and into passageway 15, so that the sound can reach the ears of the user.

Use plug 14 is typically formed of a resilient plastic material, of which flange 16 forms an acoustic seal between the plug and aperture 2 of the structure.

Electrical contact 18 has a bifurcated shape, is contained within hollow valve 6, and has two rounded extremities substantially terminating the contact at the lower, open end of the valve. Contact 18 is fabricated of spring material, such as beryllium copper, which is preferably gold plated. The ends are chamfered to increase clearance from spring 10.

This contact motionally coacts with stationary contacts 19 and 20. The assembly constitutes a single pole switch that is open-circuited when valve 6 is up (as shown in FIG. 1), and closed-circuited when the valve is down.

It is preferred, although not mandatory, that one stationary contact, as 19, be longer and so in mechanical and electrical contact at all times. This minimizes the wear on this contact.

Typically, contacts 19 and 20 are heavy deposits of printed circuit conductor upon a small printed circuit board 21. This board can also carry other parts of a printed circuit or connecting wires 22. Contacts 19 and 20 are preferably gold plated 0.0013 mm thick.

It is seen that wiping contact is obtained between contacts 18, 19 and 20, thus maximizing effective electrical functioning. Also, the contacts are protected from foreign particles and/or liquid that might be (accidentally) deposited in aperture 2 when plug 14 is removed, as occurs during many hours in an airplane or other vehicle.

In the circuit for providing sound from transducer 3, contacts 18, 19 and 20 may merely open the circuit to the transducer when plug 14 is removed, or a resistor of relatively high resistance value may be shunted electrically across the contacts. When this is done the transducer continues to operate, but at a very low electrical and acoustic level. A resistor of approximately 1,000 ohms is suitable, but is not shown.

Figure 3:
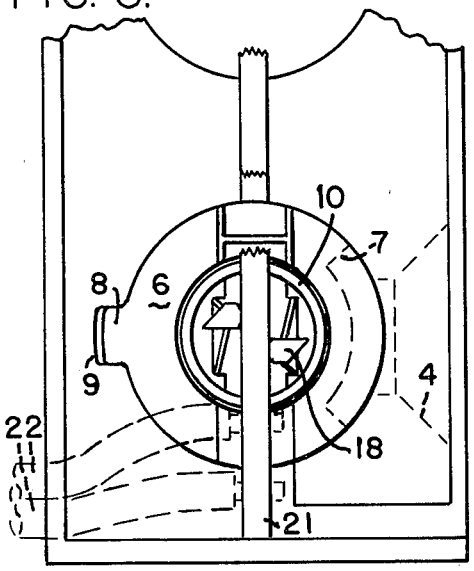
FIG. 3 is a bottom view of the same, showing contacts.

Switch member 18 is formed with the bifurcated parts laterally staggered, as seen in the bottom view of FIG. 3. Stationary contacts 19 and 20 are similarly staggered so that proper wiping contact will be made. The staggered construction allows the bifurcated parts of 18 to be easily formed and bent to have the desired grasping tension on the stationary contacts. Also, if gold or other plating is provided the plating will cover properly on the inside surfaces of the extremities of the bifurcated parts, which are the essential electrical contact areas.

Figure 4:
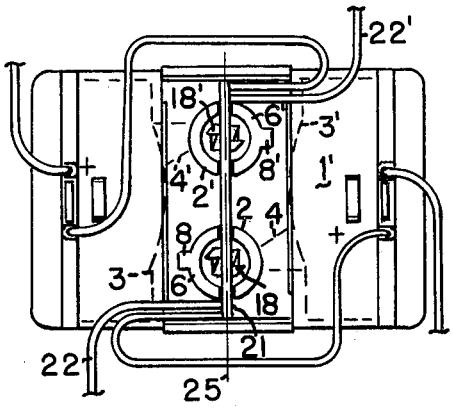
FIG. 4 is a whole bottom view of a dual aperture structure.

FIG. 4 is the bottom view of the dual aperture structure. It is essentially a mirror image duplication of the single aperture construction, being symmetrical about central plane 25. The spacing between apertures 2 and 2' is standard, being 1.016 cm, as are the diameters, being 7 mm per Arinc 574.

For the dual structure, printed circuit board 21 is preferably fabricated in one piece, with contacts 19 and 20 at one extremity and 19' and 20' at the other extremity. Silk screened resistors can be deposited on the board, between contacts 19 and 20 and between contacts 19' and 20', if this circuit arrangement is desired, rather than an otherwise total open circuit, when one-piece dual plug 14, 14' is removed.

Conventional wires 22 connect to the external circuit.

A snap-in rear cover 23 is preferably provided at the bottom of body 1. See FIG. 1, it is of insulating material and serves to enclose the contact structure.

Spring 10, in extending from the "bottom" of body 1, preferably extends from approximately the midpoint, vertically, of printed circuit board 21, as shown in FIG. 1.

I claim:

1. An electro-acoustical structure comprising;

(a) a body (1) having at least one aperture (2) for receiving an acoustic-use plug (14), (b) a hollow piston valve (6) within said aperture, (c) a coiled spring (10) within said aperture and bearing outwardly against said piston valve with respect to said aperture, (d) a port (4) having an electro-acoustical transducer (3) within said body and acoustically communicating with said aperture, (e) a companion port (7) within said piston valve so related to said port (4) that when an acoustic-use plug is inserted into said aperture an acoustic channel exists from said transducer, through said port, through said companion port, and into the acoustic-use plug, (f) a bifurcated electrically conductive switch member (18) disposed within said piston valve, and (g) linear stationary contacts (19,20) to close an electrical circuit in coaction with said bifurcated switch member, when said piston valve is depressed within said aperture.

2. The structure of claim 1, which additionally includes;

(a) a keyway (9) in said aperture, (b) a key (8) upon said piston valve to fit within said keyway, the key and keyway formed so that the circumferential relation to the port (4) within said body and the companion port (7) within said piston valve remain in alignment.

3. The structure of claim 2, in which;

(a) said keyway has a limited length, to thereby retain said piston valve within said body.

4. The structure of claim 1, in which said piston valve includes;

(a) castellations formed in the top surface thereof to form plural acoustic passages therein.

5. The structure of claim 4, in which;

(a) said castellations are formed with ramped surfaces to inhibit rotation of said piston valve with an external object.

6. The structure of claim 1, which;

(a) said stationary contacts are of unequal length, whereby one (19) of said stationary contacts remains in contact with said bifurcated switch member regardless of the position of said piston valve.

7. The structure of claim 1, in which;

(a) said bifurcated switch member (18) is formed with the bifurcated parts laterally staggered, and (b) said stationary contacts (19,20) are respectively aligned with the bifurcated parts.

8. The structure of claim 1, in which;

(a) said body (1') has two separate adjacent parallel apertures (2,2'), (b) a said piston valve (6,6') in each aperture, (c) a coiled spring (10,10') in each aperture, (d) separate ports (4,4') within said body acoustically communicating with a said aperture, (e) a companion port (7,7') within each piston valve so related to a said separate port that when a dual acoustic-use plug (14,14') is inserted into both apertures a separate acoustic channel exists from each said port, through each said piston valve, and separately through the dual acoustic-use plug, (f) a bifurcated electrically conductive switch member (18,18') disposed within each said piston valve, and (g) separate pairs of stationary contacts (19,20,19', 20') to close two separate circuits in coaction with the two bifurcated switch members when said piston valves are depressed within said two apertures.

9. The structure of claim 8, in which;

(a) said stationary contacts (19,20 & 19',20') are disposed on opposite sides of a printed circuit board (21).

* * * * *